US007294002B2

(12) United States Patent
Noro et al.

(10) Patent No.: US 7,294,002 B2
(45) Date of Patent: Nov. 13, 2007

(54) CONNECTOR DEVICE

(75) Inventors: Yutaka Noro, Yokkaichi (JP); Yutaka Kobayashi, Yokkaichi (JP)

(73) Assignee: Sumitomo Wiring Systems, Ltd (JP)

( * ) Notice: Subject to any disclaimer, the term of this patent is extended or adjusted under 35 U.S.C. 154(b) by 19 days.

(21) Appl. No.: 11/635,876

(22) Filed: Dec. 8, 2006

(65) Prior Publication Data

US 2007/0134958 A1 Jun. 14, 2007

(30) Foreign Application Priority Data

Dec. 8, 2005 (JP) ..... 2005-355014

(51) Int. Cl.
*H01R 13/62* (2006.01)

(52) U.S. Cl. ..... 439/157; 439/342; 439/911

(58) Field of Classification Search ..... 439/157, 439/342, 372, 374, 911
See application file for complete search history.

(56) References Cited

U.S. PATENT DOCUMENTS 6,045,410 A 4/2000 Norizuki et al.
6,217,363 B1 4/2001 Takata
6,296,502 B1 10/2001 Takata et al.
6,343,944 B1 * 2/2002 Okabe ..... 439/157
6,547,574 B2 * 4/2003 Sasaki et al. ..... 439/157
6,948,953 B2 * 9/2005 Fukamachi ..... 439/137
7,063,547 B2 * 6/2006 Toyoda et al. ..... 439/157
2004/0077197 A1 4/2004 Nishide
2006/0223383 A1 10/2006 Kobayashi et al.

FOREIGN PATENT DOCUMENTS

JP 2000-286015 10/2000

* cited by examiner

*Primary Examiner*—Thanh-Tam Le
(74) *Attorney, Agent, or Firm*—Gerald E. Hespos; Anthony J. Casella

(57) ABSTRACT

A connector device is provided with a box-shaped casing (50), a female housing (30) mounted into the casing (50) and displaceable between an initial position and an end position, and a slide (70) that is in the form of a frame having an operating portion (72) and mounted in the casing (50) for movement between a retreat position where a clearance exists between the operating portion (72) and the casing (50) and an advance position that narrows or eliminates the clearance. Before an operation of connecting both male and female housings (10, 30) is started, a protector (90) is inserted into a fitting space (91) between the operating portion (72) of the slide (70) and the casing (50). The slide (70) is held at the retreat position and the female housing (30) is held at the initial position by the protector (90).

7 Claims, 15 Drawing Sheets

CONNECTOR DEVICE

BACKGROUND OF THE INVENTION

1. Field of the Invention

The invention relates to a connector device.

2. Description of the Related Art

U.S. Pat. No. 6,217,363 discloses a connector device with first and second housings that are connectable with each other. The first housing is accommodated in a casing and the two housings are engaged by the entrance of the second housing into the casing from above. The first housing is displaced towards the second housing by a cam mechanism formed between the first housing and the casing. The two housings are connected properly by inserting the second housing completely into the casing. Accordingly, this connector device has a feature of turning approaching directions of the two housings by about 90° and setting the resulting directions as connecting directions of the two housings.

There is a demand to use a lever for assisting connection and reducing an operational load when a connector has many contacts. To meet this demand, a cam is provided in the second housing of the above-described connector and a lever is mounted rotatably in the casing. The lever has a cam receiving portion that is engageable with the cam.

A slide can be mounted in the casing at a position spaced from the center of rotation of the lever. The slide and the lever are configured so that forward and backward movement of the lever rotates the lever, even if the lever is at a position that is difficult to maneuver. However, the positions of the first housing and the slide relative to the casing can shift before starting connection of the two housings.

A testing apparatus may be required at an operation site for testing whether the slide is at the initial state. A slide that is not at the initial state will have to be pushed to the initial state at the operation site. Thus, there is a problem of being unable to start the connection of the two housings quickly.

The invention was developed in view of the above situation and an object thereof is to ensure good operability while performing a connector connecting operation and suppressing cost increase.

SUMMARY OF THE INVENTION

The invention relates to a connector device with a casing that has a side wall and at least one guiding cam means formed in the side wall. The connector device also has first and second housings. The second housing is mountable into the casing and has at least one mating guiding cam means that is engageable with and guidable by the guiding cam means and that is displaceable between an initial position and an end position. The second housing is connectable with a first housing that is inserted into the casing at the end position. A moving member is mounted for movement between a retreat position and an advance position. The moving member has an operating portion and at least one moving mounting portion. A clearance is defined between the operating portion and the casing when the moving member is in the retreat position. However, the clearance is narrowed or eliminated when the moving member is moved from the retreat position to the advance position while the slide mounting portion engages the casing. At least one operable member is mounted on one of the moving member and the casing, and has at least one cam receiving portion engaged with and supported on the other of the moving member and the casing. The cam receiving portion is engageable with at least one cam on the first housing. The operable member is operated by moving the moving member from the retreat position to the advance position. Thus, the first housing is inserted more deeply into the casing by the cam action of the cam and the cam receiving portion, and the second housing engaged with the first housing is displaced from the initial position to the end position by the guiding action of the mating guiding cam means and the guiding cam means to connect the housings properly. A protector is insertable into the clearance between the operating portion and the casing before the first housing is inserted into the casing. The protector contacts the operating portion and the second housing to hold the moving member at the retreat position and to hold the second housing at or near the initial position.

The second housing is mounted at or near the initial position in the casing and the moving member is arranged at or near the retreat position in the casing. In this state, the protector can be inserted into the clearance between the operating portion of the moving member and the casing. The connector device that has been fit with the protector then is transported to an operation site where the two housings are to be connected. The moving member is held at or near the retreat position and the second housing is held at or near the initial position while the protector is mounted. The protector is detached at the operation site and the connection of the two housings then can be started quickly. The protector guarantees that the second housing and the moving member (hereinafter, referred to as movable members) are in their initial states. Thus, a separate and testing device is not needed to confirm the positions of the movable members, thereby avoiding excess installation costs. Further, the movable members can not move inadvertently relative to the casing even if an external force acts during transportation.

The moving member preferably is substantially frame-shaped and has one or more plate-shaped moving mounting portions that project from an operating portion.

The operable member preferably comprises a lever rotatably mounted on one of the moving member and the casing. Additionally, the operable member preferably has at least one cam receiving portion engaged with and supported on the other of the moving member and the casing at a position spaced from the center of rotation of the lever.

The protector preferably extends between the operating portion and the second housing by being inserted into the clearance. Thus, the movable members do not need structure for engaging the protector and the protector can be inserted easily without damaging the movable members.

The moving member preferably is formed with an insertion space for receiving a holding member that is fixable to a mounting surface.

The holding member preferably holds the moving member at the retreat position, and the protector preferably has an insertion hindering portion for at least partly closing the opening of the insertion space when the protector is inserted into the clearance. Thus, as long as the protector is mounted, the holding member cannot be mounted at the operation site. Accordingly, an operator is obliged to detach the protector before mounting the moving member onto the holding member and must comply with an operation procedure. As a result, the moving member cannot be mounted improperly onto the holding member.

At least one lock is formed in an exposed manner on the operating portion of the moving member and is engageable with the holding member fixed to the mounting surface at the retreat position. Additionally, the protector includes a protecting portion for at least partly covering an exposed surface of the lock when the protector is inserted into the clearance. Thus, the lock cannot be damaged before the connecting operation of the two housings is started since the exposed surface of the lock is covered by the protecting portion of the protector.

The invention also relates to a method of assembling or mounting the above-described connector device.

These and other objects, features and advantages of the present invention will become more apparent upon reading of the following detailed description of preferred embodiments and accompanying drawings. It should be understood that even though embodiments are separately described, single features thereof may be combined to additional embodiments.

BRIEF DESCRIPTION OF THE DRAWINGS

FIG. 12 is a section showing an essential portion of the movable-side module having the protector mounted in.

DETAILED DESCRIPTION OF THE PREFERRED EMBODIMENTS

Figure 1:
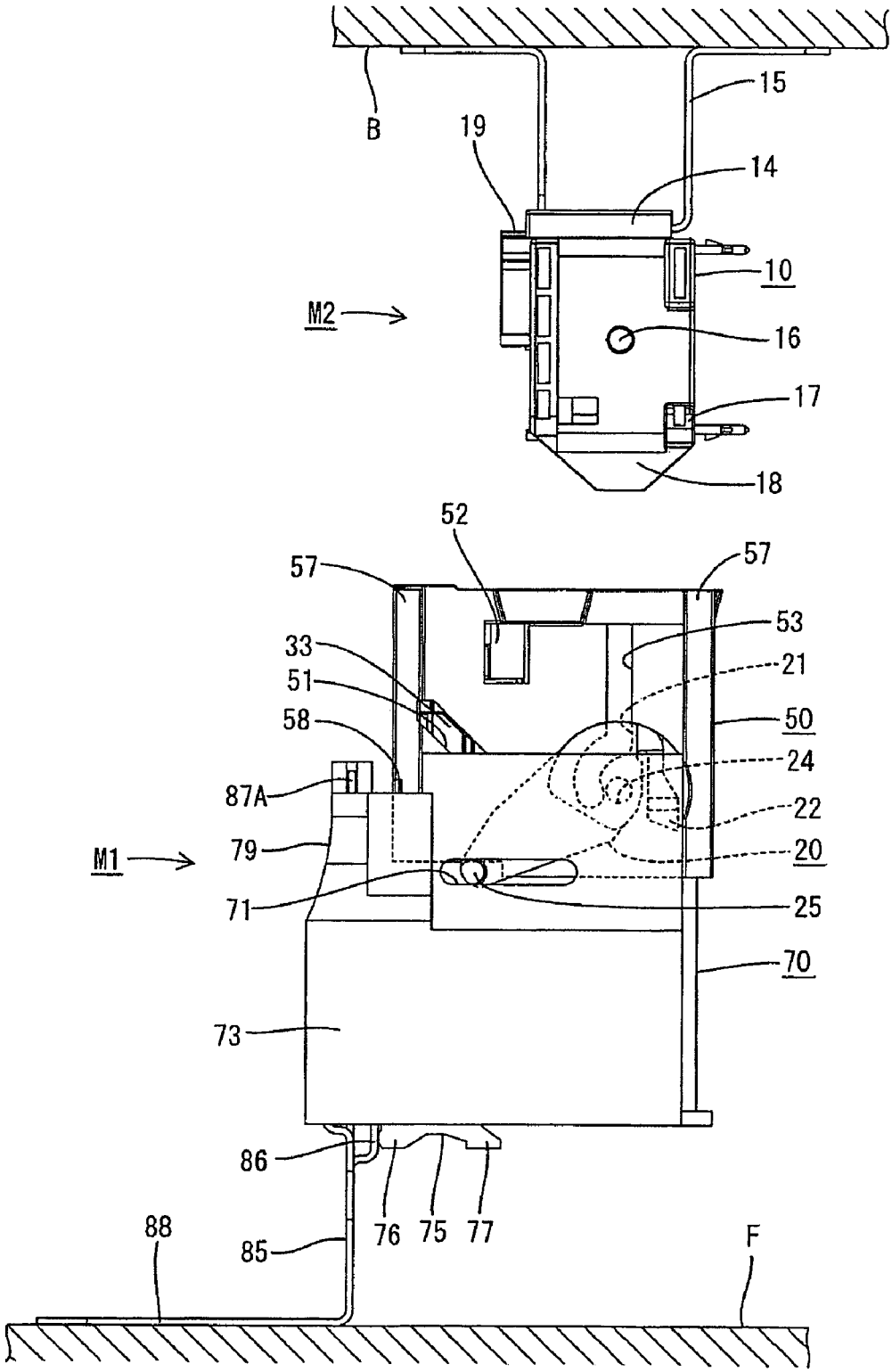
FIG. 1 is a side view of one embodiment of the invention showing a state where a waiting-side module and a movable-side module are opposed to each other at a distance.

A connector device in accordance with the invention is illustrated in FIGS. 1 to 15. The connector device has male and female housings 10 and 30 that are connectable with one another. Ends of the housings 10, 30 that are to be connected are referred to as the front ends, and reference is made to FIG. 1 concerning the vertical direction in the following description.

A movable-side module M1 is provided at a mounting surface F of a mounting element, such as a dashboard of an automotive vehicle, and the female housing 30 is arranged movably on the module M1. A waiting-side module M2 is provided on a mounting surface B, e.g. of an engine compartment, substantially facing the mounting surface F and the male housing 10 is to be fixed to the module M2.

The movable-side module M1 includes the female housing 30, a casing 50, a slide 70, levers 20 and a protector 90. The female housing 30 is in the casing 50. Additionally, the slide 70 and the protector 90 are mounted to the casing 50. The protector 90 can be detached from the casing 50 and the slide 70 can be pushed towards the engine compartment so that the male housing 10 can be inserted into the casing 50. A cam mechanism moves the housings 10, 30 closer at substantially right angles to the pushing direction, and the housings 10, 30 reach a properly connected state by pushing the slide 70.

Figure 14:
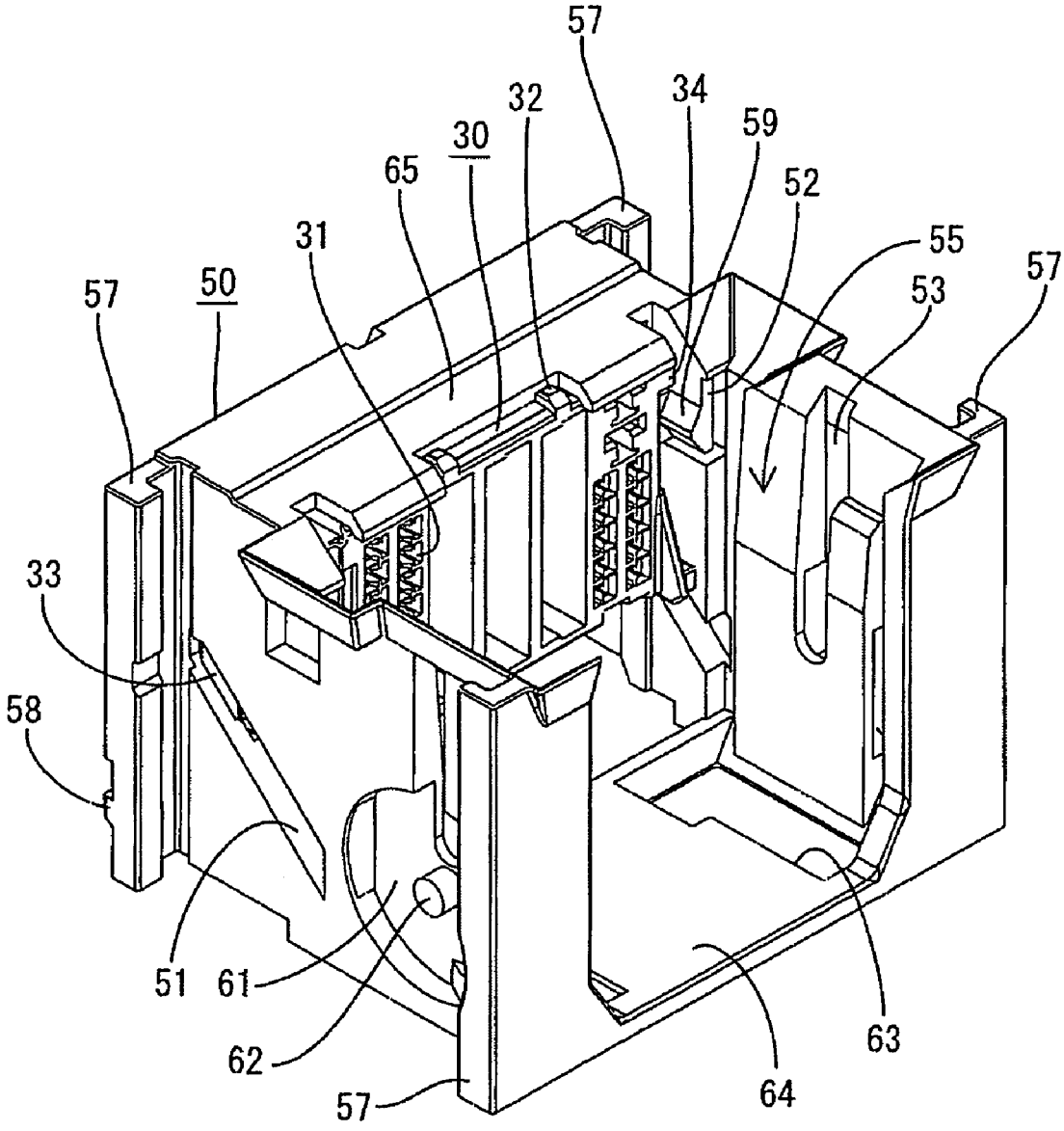
FIG. 14 is a perspective view of the casing having the female housing mounted therein.

The female housing 30 is substantially in the form of a block made e.g. of a synthetic resin. Cavities 31 are formed in the female housing 30 and are configured to receive unillustrated female terminals. As shown in FIG. 14, left and right projections 32 are formed on the upper surface of the female housing 30. The projections 32 engaged a moving plate 11 in the male housing 10 to bring the moving plate 11 from a retracted position to an initial position.

Left and right guiding cams 33 project from the opposite side surfaces of the female housing 30 and have polygonal shapes when viewed sideways. The guiding cams 33 fit into guiding cam grooves 51 in the casing 50 and move along an extending direction of the guiding cam grooves 51. The guiding cams 33 are substantially polygonal when viewed from the side and have substantially parallel upper and lower surfaces that can slide in surface contact with the opposite side edges of the corresponding guiding cam grooves 51 to prevent pivoting of the female housing 30 about the guiding cams 33. The female housing 30 is displaceable between an initial position where each guiding cam 33 is at one end of the corresponding guiding cam groove 51 and an end position where each guiding cam 33 is at the other end of the corresponding guiding cam groove 51. The female housing 30 is connected properly with the male housing 10 at the end position. Left and right temporary holding portions 34 project at the front upper ends of the opposite side surfaces of the female housing 30. The temporary holding portions 34 engage the temporary engaging portions 52 in the casing 50 to keep the female housing 30 at the initial position.

The male housing 10 is made e.g. of a synthetic resin and has a terminal accommodating portion 12 for receiving unillustrated male terminal fittings. A tubular receptacle 13 projects forward from the front surface of the terminal accommodating portion 12 and a rail 14 is formed at the upper surface of the male housing 10. A mounting member 15 projects from the mounting surface B and can slide forward and back along the rail 14. Thus, the male housing 10 is fixed to the mounting surface B via the mounting member 15. Left and right cams 16 project from the opposite side surfaces of the male housing 10. The cams 16 have substantially cylindrical shapes and are inserted into cam insertion grooves 53 in the casing 50. The inserted cams 16 are guided into engagement with cam receiving recesses 21 in the levers 20. The cams 16 then displace along the cam receiving recesses 21 as the levers 20 are rotated and exhibit a cam action to connect the two housings 10, 30.

Left and right guiding projections 17 project from the rear ends of the opposite side surfaces of the male housing 10. Both guiding projections 17 are fit into guiding grooves 54 in the casing 50 and engage resilient locking pieces 22 on the levers 20 to deform the resilient locking pieces 22 in unlocking directions. A truncated pyramidal or conical detector 18 projects from the bottom surface of the male housing 10. The width of the detector 18 narrows towards the bottom end, and the slanted surfaces thereof guide the detector smoothly into an upper opening 55 of the casing.

Tabs of the male terminal fittings project into the receptacle 13. A pressing portion 19 is formed at the upper wall of the receptacle 13 and has an open bottom end. The female housing 30 is pulled towards the male housing 10 with the upper surface of the female housing 30 pressed by the inner side of the pressing portion 19. Further, a moving plate 11 made e.g. of a synthetic resin material is assembled in the receptacle 13. The moving plate 11 is located protectively before or adjacent the tips of the male terminal fittings before the connection of the housings 10, 30 starts. However the female housing 30 and/or a cam action displayed by the levers 20 and/or the slide 70 pushes the moving plate 11 back when the two housing 10, 30 are connected. Thus, the tabs to penetrate through the moving plate 11.

The casing 50 is made e.g. of a synthetic resin and has a box-shape that is open in both front and rear surfaces. The male housing 10 can be received into the casing 50 from above through an upper opening 55 in the front of the upper surface, whereas the female housing 30 can be received into the casing from below through a bottom opening 56 in the rear portion of the bottom surface. Slide guides 57 project from the outer surfaces of the opposite side walls of the casing 50 and extend vertically in substantially the entire area, and movements of the slide 70 are guided along the slide guides 57. Left and right engaging portions 58 project at positions of the casing 50 at the opposite sides of the rear opening and substantially corresponding to the slide guides 57.

Guiding cam grooves 51 penetrate the opposite side walls of the casing 50 in the thickness direction and are engageable with the guiding cams 33 of the female housing 30. The guiding cam grooves 51 are substantially straight in the rear portion of the opposite side walls of the casing 50 and incline down toward the front. The female housing 30 is moved substantially forward along the straight guiding cam grooves 51 to approach the male housing 10. The temporary engaging portions 52 are formed by substantially U-shaped cuts in the opposite side walls of the casing 50 above the guiding cam grooves 51 and are resiliently deformable in and out. Temporary holding projections 59 project into the casing 50 from the leading ends of the temporary engaging portions 52 and are engageable with the temporary holding portions 34 of the female housing 30. The female housing 30 is pressed down upon engaging the male housing 10 in a state where the female housing 30 is kept at the initial position by the engagement of the temporary holding portions 34 and the temporary holding projections 59. Thus, the temporary engaging portions 52 deform resiliently outward to disengage the temporary holding projections 59 from the temporary holding portions 34. As a result, forward movement of the female housing 30 is permitted.

Substantially circular lever mounting portions 61 are formed before the guiding cam grooves 51 by recessing the outer surfaces of the opposite side walls of the casing 50. Substantially cylindrical supporting pins 62 stand concentrically in the centers of the lever mounting portions 61 for rotatably supporting the levers 20. The levers 20 are rotatable about the supporting pins 62. The cam insertion grooves 53 are formed in the opposite side walls of the casing 50 and extend substantially vertically up along the connecting direction from the supporting pins 62 to the upper edge of the casing 50. The entrances of the cam receiving recesses 21 of the levers 20 face the cam insertion grooves 53 when the levers 20 are at rotation starting positions. The cams 16 of the male housing 10 enter the cam insertion grooves 53 from above and further enter the entrances of the cam receiving recesses 21.

Guiding grooves 54 are formed in the inner surfaces of the opposite side walls of the casing 50 and are substantially parallel with the cam insertion grooves 53. The resilient locks 22 in the levers 20 engage the edges of the guiding grooves 54 to keep the levers 20 at the rotation starting positions. The guiding projections 17 of the male housing 10 enter the guiding grooves 54 from above to cancel the locked state by the resilient locking pieces 22 so that the levers 20 can rotate.

Each lever 20 is made e.g. of a synthetic resin and includes a plate-shaped arm 23. A substantially disk-shaped portion is formed on the inner surface of the arm 23 by increasing the thickness of the arm 23, and is fit slidably into the lever mounting portion 61. As shown in FIG. 1, the cam receiving recess 21 is curved in a specified direction in the inner surface of the arm 23, and a substantially round supportable recess 24 is formed in the vicinity of the cam receiving portion 21 and can fit on the supporting pin 62.

The cantilevered resilient locking piece 22 extends along the peripheral edge of each arm 23 and is resiliently deformable in and out. The free leading ends of the resilient locking pieces 22 are pressed by the corresponding guiding projections 17 while engaged with the edges of the corresponding guiding grooves 54. Thus, the resilient locking pieces 22 deform out away from each other and the leading ends thereof come out of the guiding grooves 54. Substantially cylindrical operating cams 25 project on the outer surfaces of ends of the arms 23 distanced from the respective supportable portions 24. The operating cams 25 engage operating cam receiving portions 71 in the slide 70 and are displaceable along the extension of the operating cam receiving portions 71.

Each lever 20 has an engaged position of the supportable portion 24 and the supporting pin 62 as a fulcrum, an engaged position of the cam receiving portion 21 and the cam 16 as a point of action and an engaged position of the operating cam 25 and the operating cam receiving portion 71 as a point of application of force where an external force is applied. The lever 20 is rotatable based on this lever action. In other words, the slide 70 is inserted deeply into the casing 50 with the cams 16 facing the entrances of the cam receiving portions 21. Thus, the operating cams 25 move along the operating cam receiving portions 71 and the levers 20 are rotated about the supporting pins 62. If the levers 20 are rotated in this way, the cams 16 move along the cam receiving portions 21. As a result, the male housing 10 is moved down relative to the casing 50 to be inserted properly into the casing 50 while pulling the female housing 30 towards the male housing 10.

Figure 7:
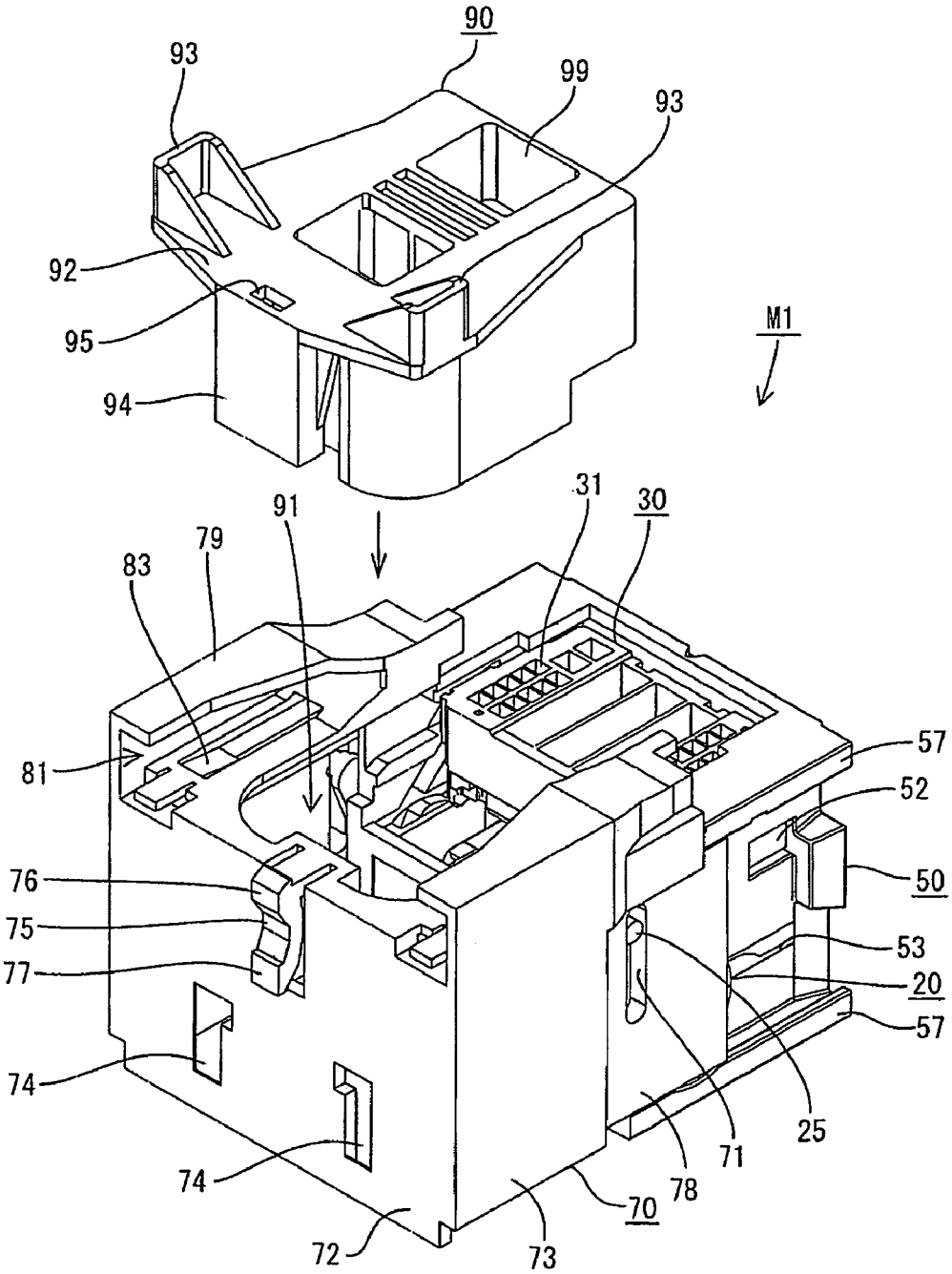
FIG. 7 is a perspective view showing a state before a protector is inserted into a fitting space defined between the casing and an operating portion of the slide member.

The slide 70 is made e.g. of a synthetic resin and has an operating portion 72. Left and right slide mounting portions 73 project from the opposite ends of the operating portion 72 to define a substantially bridge-shape, as shown in FIG. 7. This slide 70 is movable substantially forward and backward between a retreat position where there is a clearance between the casing 50 and the operating portion 72 and an advance position where the clearance between the casing 50 and the operating portion 72 is narrowed or eliminated. At the retreat position, the slide 70 is held on a holding member 85 fixed to the cockpit-side mounting surface F.

The operating portion 72 is a substantially flat plate and has a detection window 74 for receiving the detector 18 of the male housing 10. The detector 18 projects out and down from the detection window 74. A projecting amount of the detector 18 can be observed to determine whether the male housing 10 has been inserted to a proper depth in the casing 50 or whether the two housings 10, 30 have been connected properly. It should be noted that the detector 18 penetrates through an insertion hole 63 in a front half 64 of the bottom surface of the casing 50 before insertion into the detection window 74.

The operating portion 72 is formed with a lock 75 that is exposed and resiliently deformable between slits formed at the substantially opposite sides thereof. The lock 75 is cantilevered from the center of one end of the operating portion 72 towards the other side, and projects more downward than the operable surface of the operating portion 72. A locking claw 76 is formed at the base end of the lock 75 and is engageable with an engaging portion 86 in the holding member 85 so that the slide 70 is held onto the holding member 85. An unlocking portion 77 is formed at the leading end of the lock 75 and can be pressed in unlocking direction to separate the locking claw 76 from the engaging portion 86 for canceling the locked state.

A step 78 is formed at a leading-end of each slide mounting portion 73, and both front and rear edges of the step 78 can slide along the slide guides 57. An operation-cam receiving portion 71 penetrates each step 78 in the thickness direction and extends substantially in a transverse direction for engaging the operation cam 25 of the lever 20. The slide 70 and the casing 50 are coupled via the levers 20 with the operation cams 25 and the operation-cam receiving portions 71 kept engaged. The levers 20 are kept at the rotation starting positions by the engagement of the resilient locking pieces 22 and the edges of the guiding grooves 54 with the operation cams 25 and the operation-cam receiving portions 71 kept engaged to keep the slide 70 at the retreat position.

Figure 15:
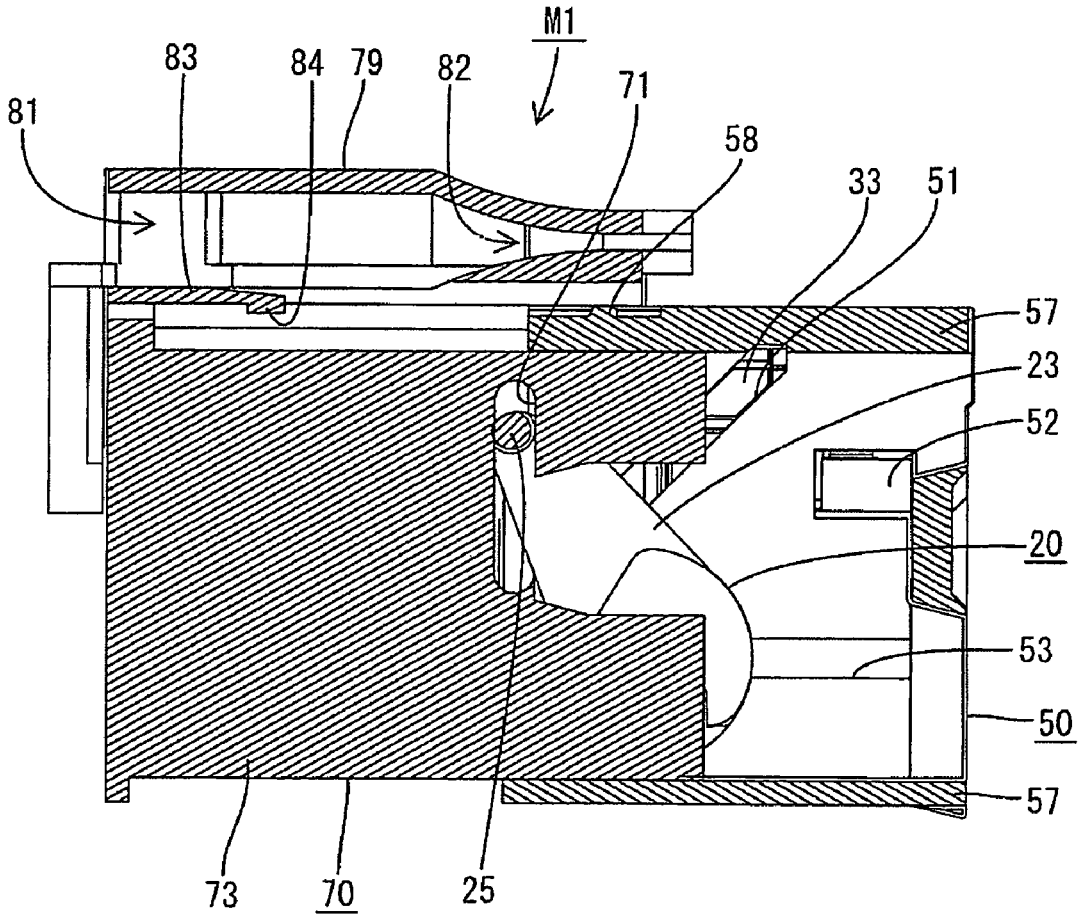
FIG. 15 is a section showing a portion of the movable-side module in a state where the slide is held at a retreat position relative to the casing.

Left and right mounting boxes 79 bulge out from the outer side surfaces of the slide mounting portions 73 at positions corresponding to the holder 85 and define tunnels that are hollow in the vertical direction. The inner spaces of the mounting box portions 79 serve as insertion spaces for receiving the leading ends of the holder 85. As shown in FIG. 15, the insertion space 81 of each mounting box 79 includes a tapered narrowed space 82, and the leading end of the holder 85 is held in pressing contact between the facing surfaces whose spacing is narrowed. When the slide 70 is pushed, the leading ends of the holder 85 smoothly exit from the narrowed spaces 82 in the pressing process to disengage the slide 70 and the holder 85 from each other. A resiliently deformable casing lock 83 is formed at the inner bottom surface of the mounting box portion 79 and is engageable with the corresponding engaging portion 58 of the casing 50. A casing locking projection 84 projects in at the free end of the casing lock 83. When the slide 70 reaches the advance position, the casing locking projections 84 are engaged with the engaging portions 58 to interlock the slide 70 with the casing 50.

Figure 6:
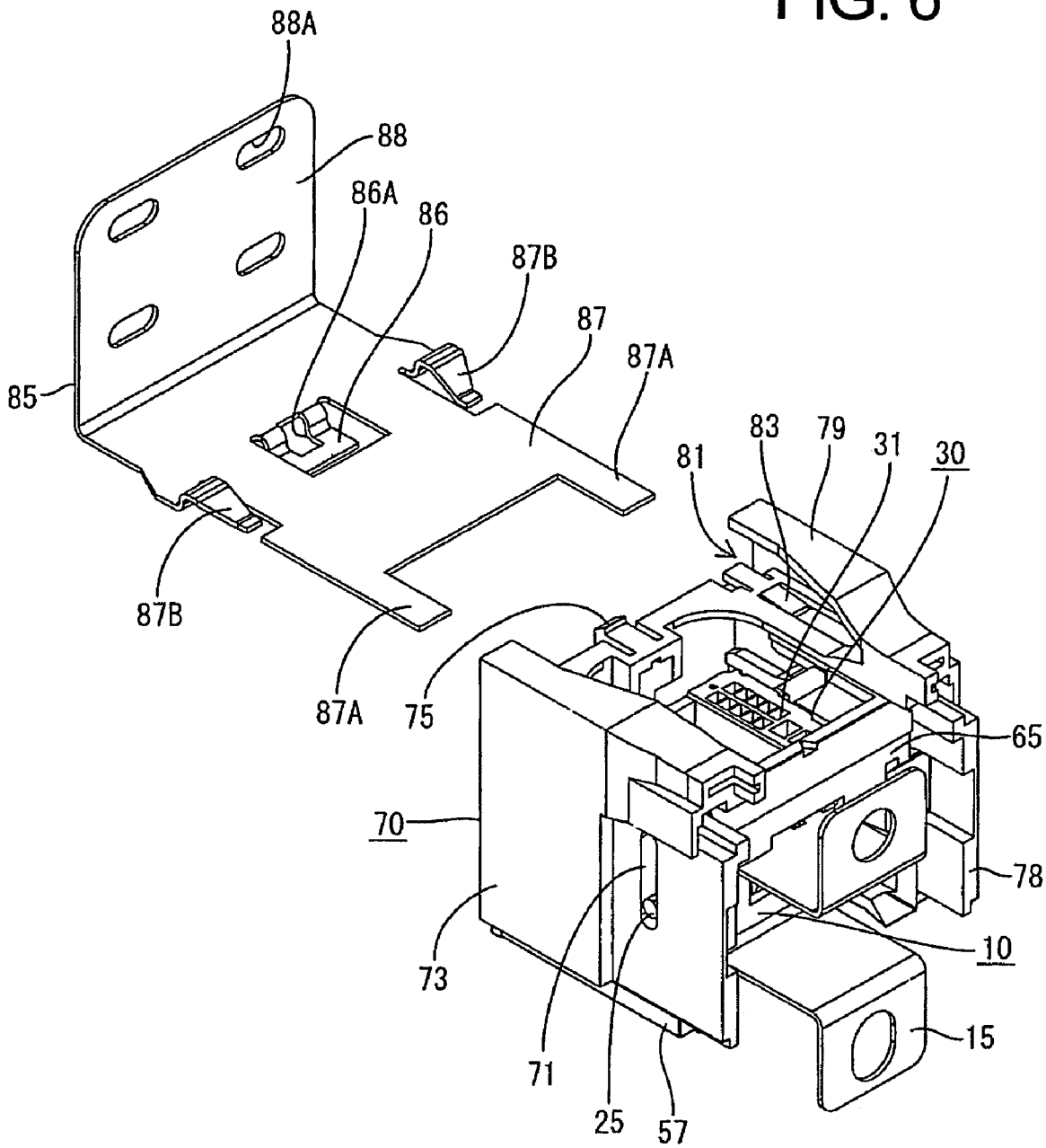
FIG. 6 is a perspective view showing a state where the male housing is inserted in the casing.

The holder 85 is formed by bending a metal plate to define a mounting plate 87 and a fixing plate 88 at a right angle to one another. Thus, the holder 85 forms a substantially L-shape, as shown in FIG. 6. Four oblong holes 88A extend through the fixing plate 88 and can receive unillustrated fixing members, such as bolts, for fixing the holder 85 to the mounting surface F. Left and right projecting pieces 87A are formed at the leading ends of the opposite lateral edges of the mounting plate 87. The projecting pieces 87A are inserted into the insertion spaces 81 of the mounting boxes 79 and are pressed between the facing surfaces of the narrowed space 82. Left and right resilient pieces 87B are formed at the opposite lateral edges of the mounting plate 87 by cutting and bending. Both resilient pieces 87B are propped in resilient contact with the inner wall surfaces of the mounting boxes 79 when the slide 70 is at the retreat position.

An interlocking portion 86 is formed substantially in the center of the mounting plate 87 at a position corresponding to the lock 75 of the slide 70. The interlocking portion 86 has a U-shaped plane at a level different from a reference plane of the mounting plate 87, and is formed at the same side as the resilient pieces 87B by cutting and bending. A locking hole 86A penetrates the interlocking portion 86 in thickness direction, and can receive the locking claw 76 of the lock 75 when the slide 70 is at the retreat position.

Figure 8:
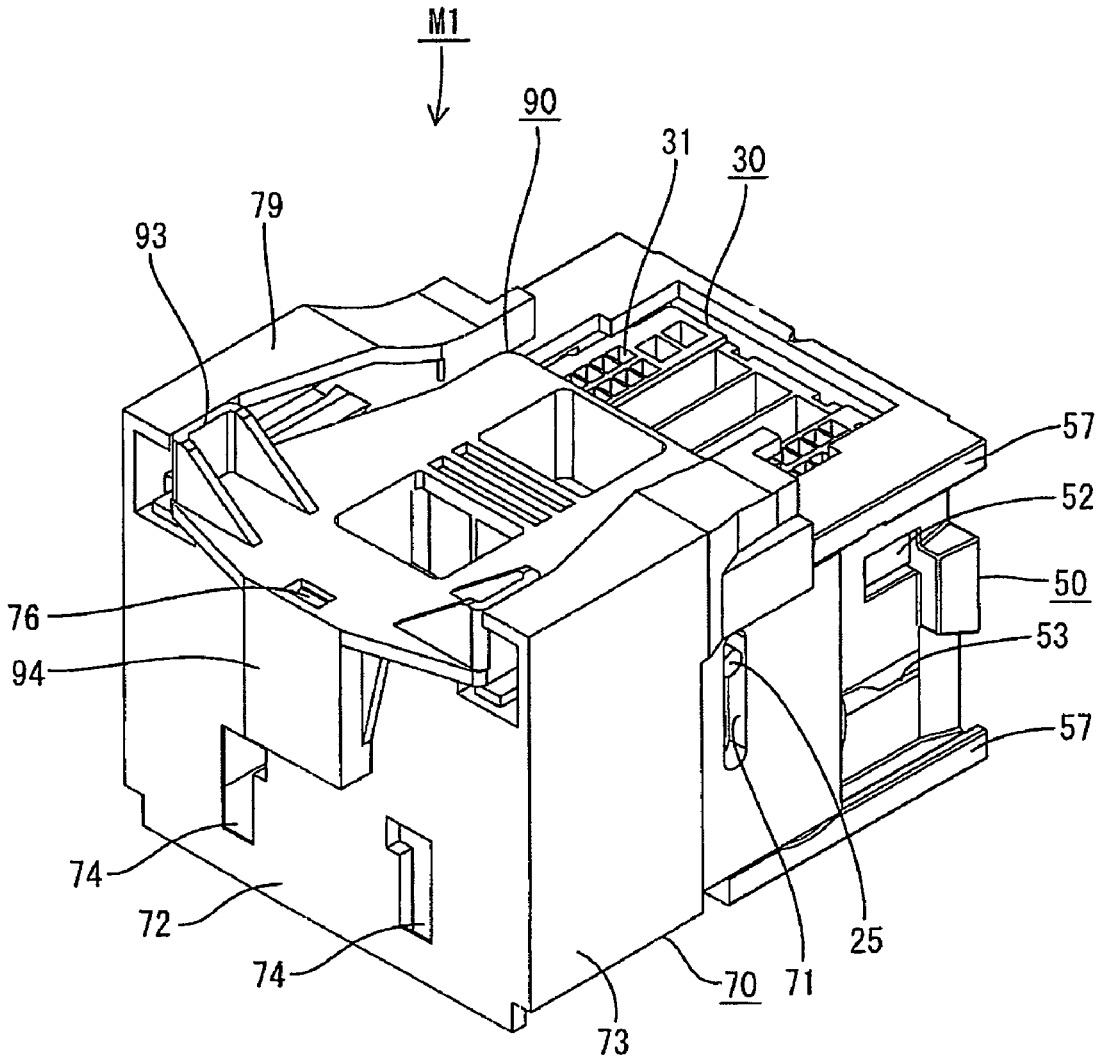
FIG. 8 is a perspective view showing a state where the protector is inserted in the fitting space.
Figure 12:
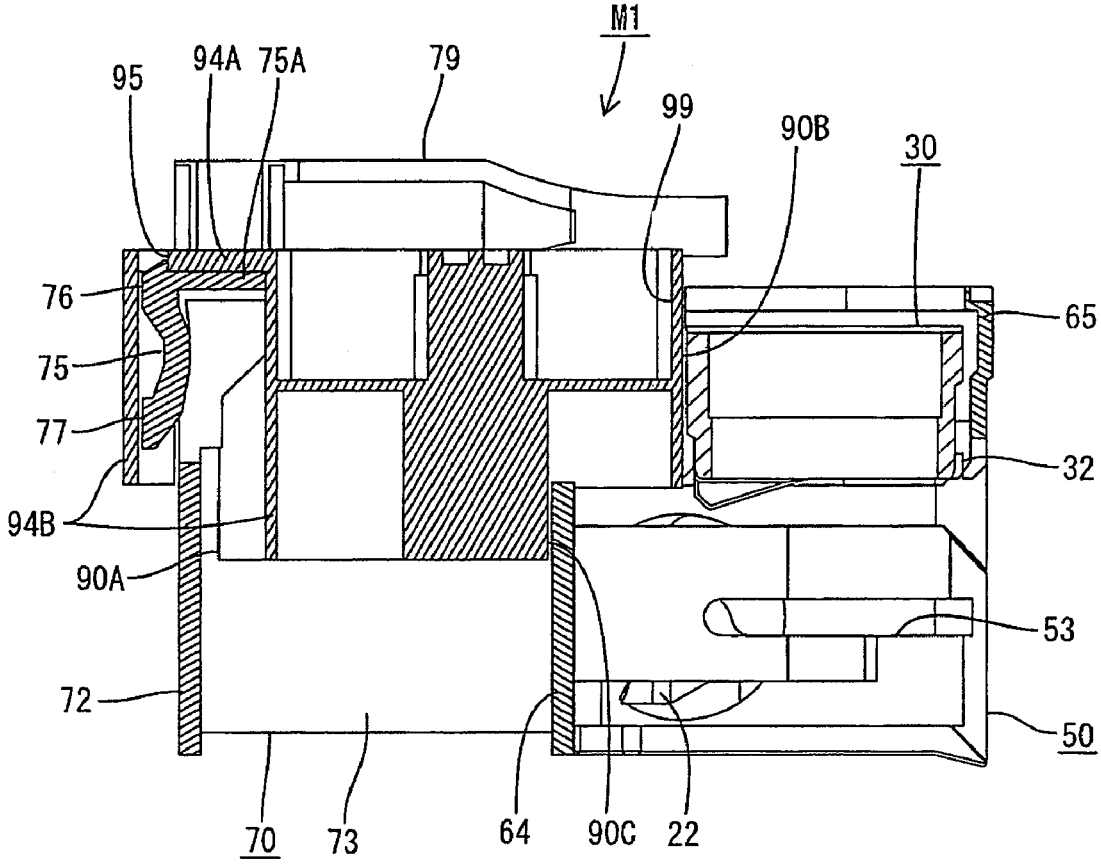
Figure 13:
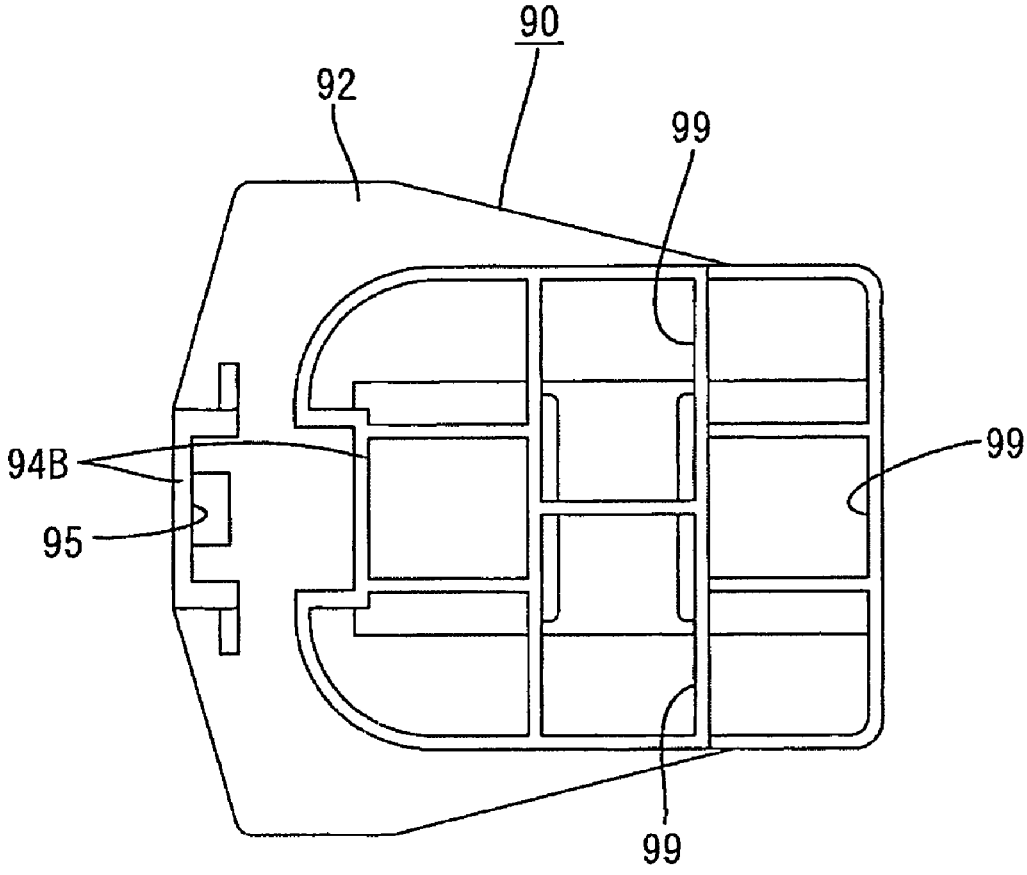
FIG. 13 is a front view of the protector.

The protector 90 can be fit into a fitting space 91 between the bottom surface of the female housing 30 and the inner surface of the operating portion 72 of the slide 70 when the female housing 30 is at the initial position in the casing 50 and when the slide 70 is at the retreat position on the casing 50. The protector 90 is in the form of a cap made e.g. of a synthetic resin and is inserted into the fitting space 91 through the rear openings of the slide 70 and the casing 50, as shown in FIGS. 7 and 8. As shown in FIG. 12, the protector 90 has first, second and third contact surfaces 90A, 90B and 90C. The first contact surface 90A can contact the inner edge of the operating portion 72. The second contact surface 90B is at a side opposite to the first contact surface 90A and can contact the bottom surface of the female housing 30. The third contact surface 90C can contact the front half 64 of the bottom surface of the casing 50, as shown in FIG. 12. The second and third contact surfaces 90B and 90C are at different levels. Further, as shown in FIG. 13, the protector 90 is provided with substantially rectangular recesses 99 at many positions.

Figure 9:
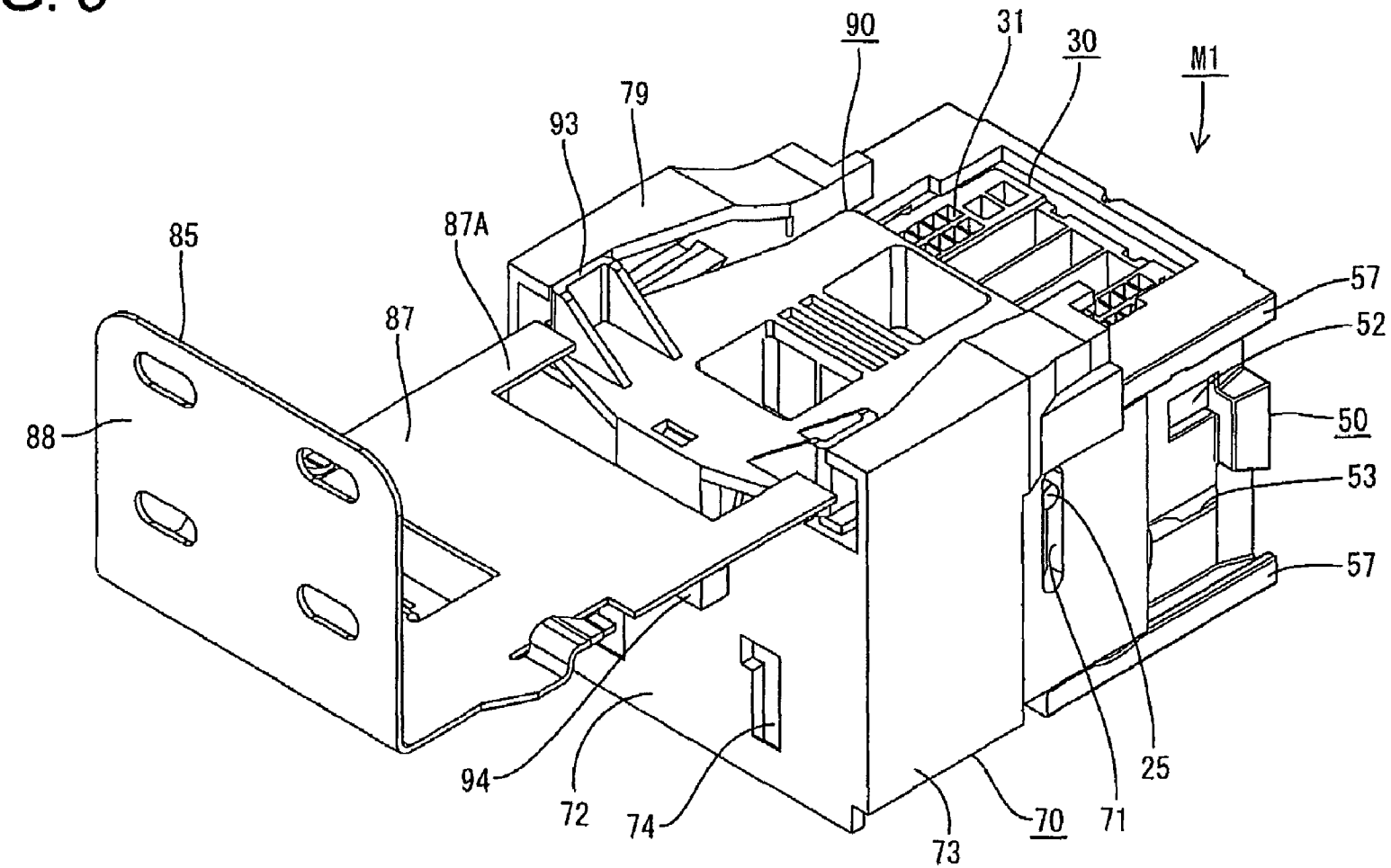
FIG. 9 is a perspective view showing a state where the mounting of a holding member is hindered by insertion hindering portions of the protector.

A substantially plate-shaped projecting piece 92 bulges out sideways on the rear of the protector 90 with respect to an inserting direction. The projecting piece 92 contacts the rear edge of the slide 70 and is stopped when the protector 90 is inserted properly. Left and right insertion hindering portions 93 project from the rear of the projecting piece 92 and can close the entrances of the insertion spaces 81 of the mounting boxes 79. The insertion hindering portions 93 have a substantially right triangular shape when viewed from the front, and the outer end surfaces thereof are substantially vertical surfaces that can contact the inner edges of notches of the mounting boxes 79, as shown in FIG. 8. Unless the protector 90 is detached, the holding member 85 cannot enter the insertion spaces 81 of the mounting boxes 79 as shown in FIG. 9.

A protecting portion 94 is provided on a side surface of the protector 90 for at least partly concealing the exposed surface of the lock 75 of the slide 70 when the protector 90 is inserted properly into the fitting space 91. The protecting portion 94 has a base wall 94A that constitutes part of the projecting piece 92 and can contact a base 75A of the lock 75. Two opposite walls 94B connect with the front surface of the base wall 94A and extend in the inserting direction of the protector 90. The lock 75 is held between the opposite walls 94B. An escaping hole 95 penetrates the base wall 94A of the protecting portion 94 in the thickness direction and receives the locking claw 76 of the lock 75. The locking claw 76 hooks the surface of the escaping hole 95 when the protector 90 is inserted properly for preventing deformation of the lock 75.

The movable-side module M1 is assembled to penetrate the base wall 94A of the protecting portion 94 in the thickness direction. Specifically, the female housing 30 is inserted into the casing 50 from below so that the guiding cams 33 fit into the guiding cam grooves 51, and the temporary holding portions 34 engage with the temporary engaging portions 52 to keep the female housing 30 at the initial position. Each guiding cam 33 is at one end of the corresponding guiding cam groove 51 and the upper surface of the female housing 30 is at a position to contact a rear half 65 of the upper surface of the casing 50. Then, the levers 20 are kept at the rotation starting positions relative to the casing 50 by the resilient locking pieces 22, so that the entrances of the cam receiving portions 21 face the cam insertion grooves 53 of the casing 50.

The slide 70 is kept at the retreat position relative to the casing 50 via the levers 20 to define the fitting space 91 between the operating portion 72 of the slide 70 and the female housing 30. In this state, the protector 90 is inserted into the fitting space 91 through the rear openings of the slide 70 and the casing 50 in a direction of arrow shown in FIG. 7. Then, as shown in FIG. 8, the rear openings of the slide 70 and the casing 50 are closed by the protector 90, and the projecting piece 92 of the protector 90 is placed on the rear edge of the slide 70. Thus, the entrances of the insertion spaces 81 of the mounting boxes 79 are closed by the insertion hindering portions 93 of the protector 90. Further, the lock 75 is covered and protected by the projecting portion 94 of the protector 90. The movable-side module M1 fit with the protector 90 in this way may be transported to an operation site where the two housings 10, 30 are connected. During the transportation, loose movements of the female housing 30 from the initial position are prevented and those of the slide 70 from the retreat position are prevented since the protector 90 extends between the female housing 30 and the operating portion 72 of the slide 70.

The waiting-side module M2 is assembled at the operation site. Specifically, the rail 14 of the male housing 10 is slid, and the male housing 10 is interlocked with the mounting member 15 fixed to the mounting surface B e.g. of the engine compartment by fixing members, such as bolts, and fixed thereto at a specified position. Further, the moving plate 11 is mounted and partly locked in the receptacle 13 of the male housing 10.

Figure 5:
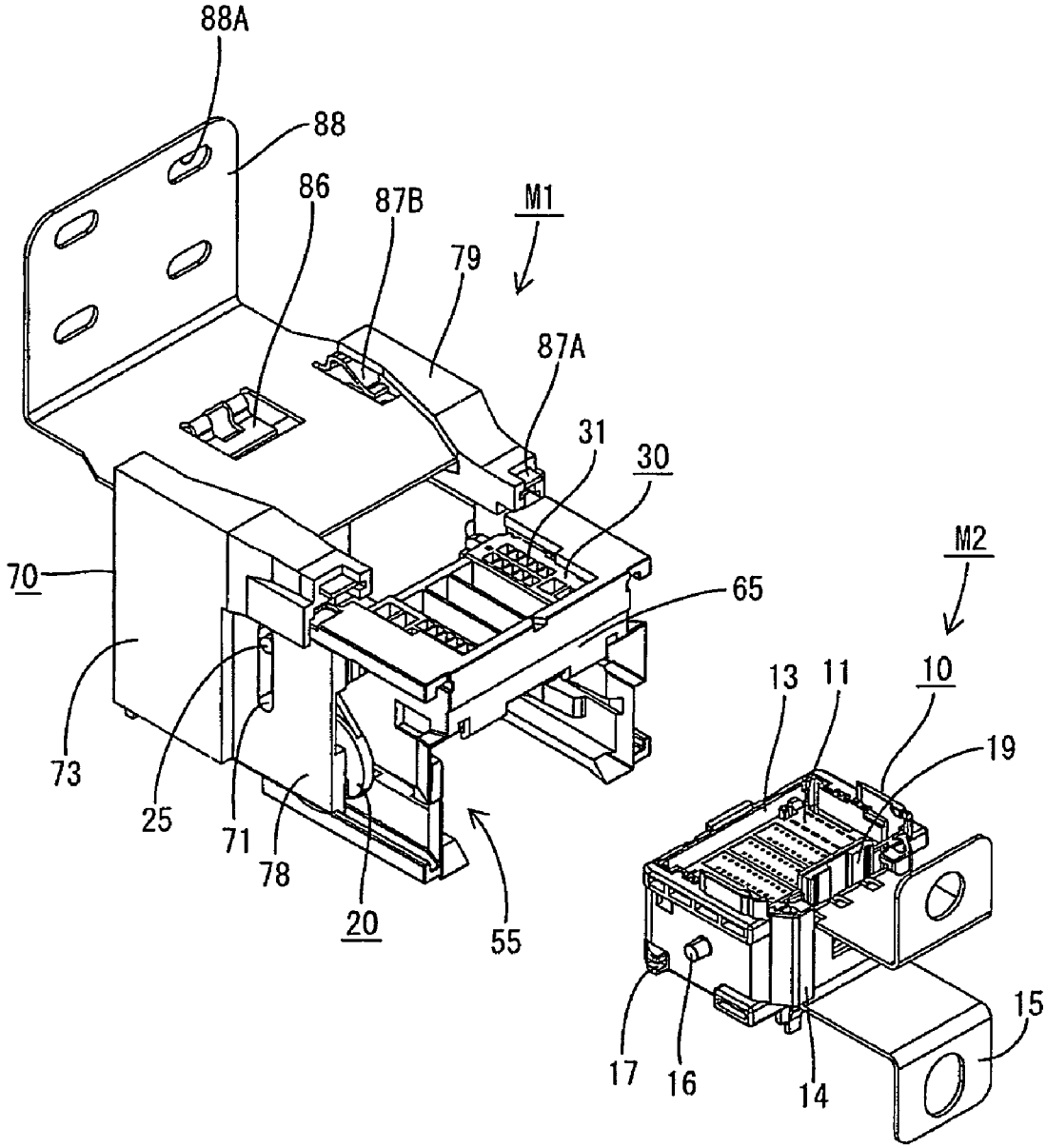
FIG. 5 is a perspective view showing a state where the waiting-side module and the movable-side module are opposed to each other at a distance.
Figure 10:
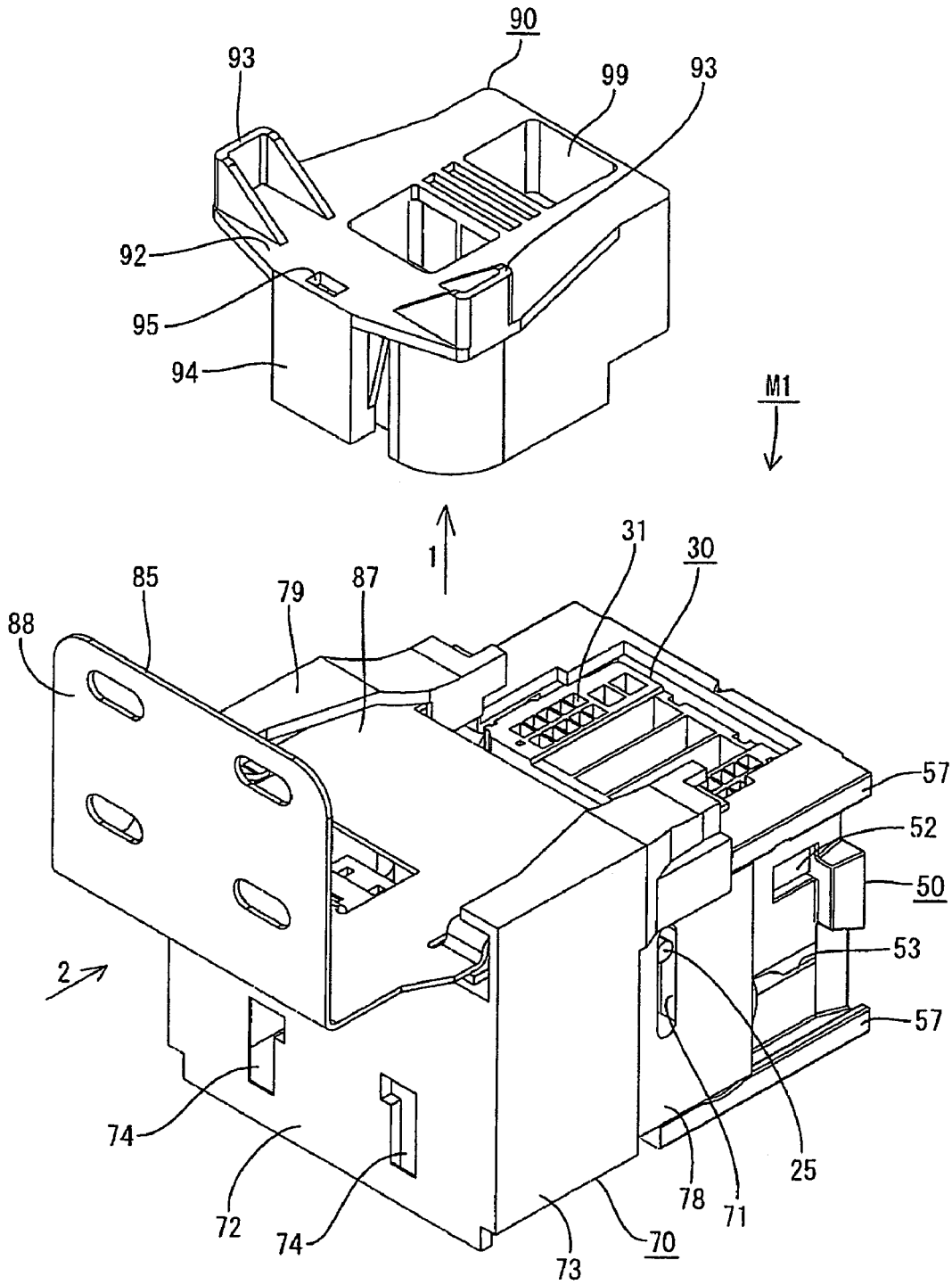
FIG. 10 is a perspective view showing a state where the protector is detached and the holder is inserted in insertion spaces of the slide.
Figure 11:
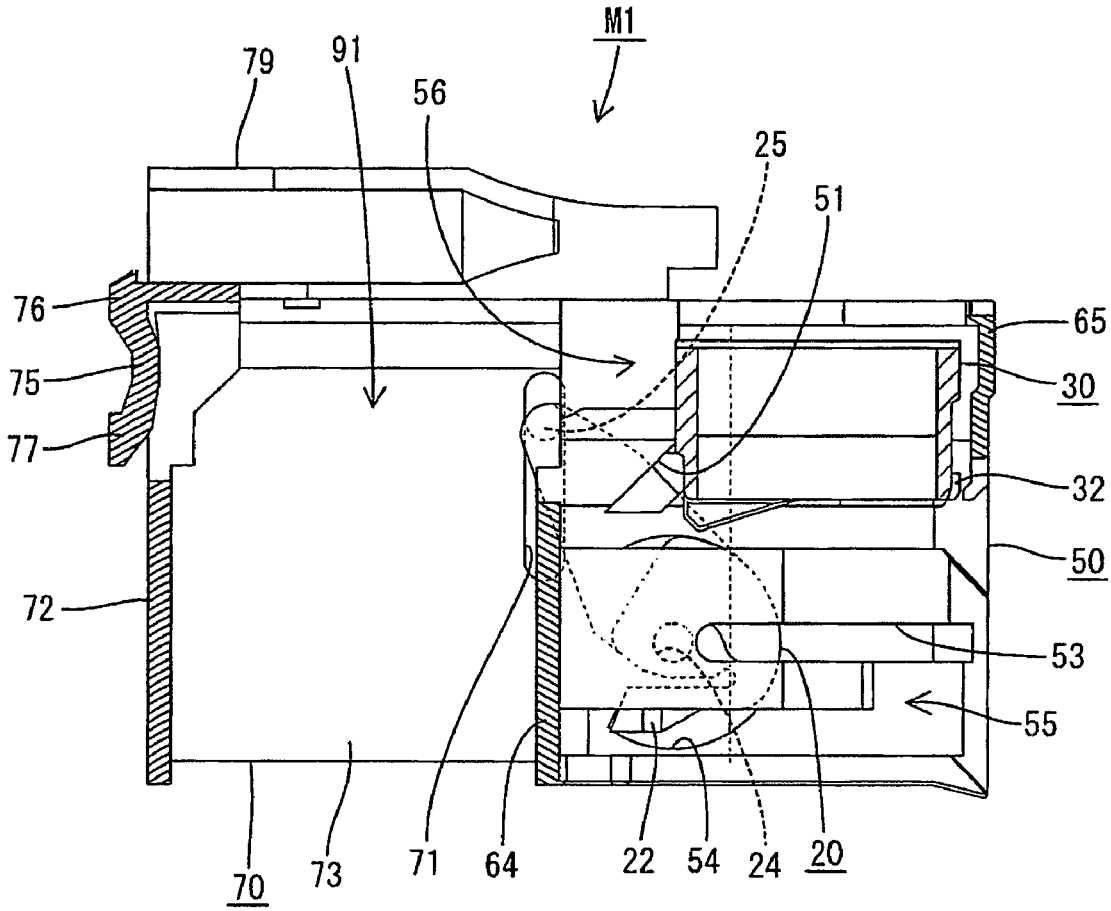
FIG. 11 is a section showing an essential portion of the movable-side module before the protector is mounted.

On the other hand, in the movable-side module M1, the protector 90 is withdrawn from the fitting space 91, as shown in FIG. 10. The projecting pieces 87A of the holder 85 then are inserted into the insertion spaces 81 of the mounting boxes 79 to engage the interlocking portion 86 of the holder 85 with the lock 75 of the slide 70. Then, as shown in FIGS. 1 and 5, the upper opening 55 of the casing 50 faces the bottom surface of the male housing 10 at a specified distance. An operator could commit an error in the operation procedure and could try to mount the holder 85 before detaching the protector 90. However, the projecting pieces 87A contact the insertion hindering portions 93 of the protector 90, as shown in FIG. 9, to hinder insertion of the holder 85 into the insertion spaces 81.

Figure 2:
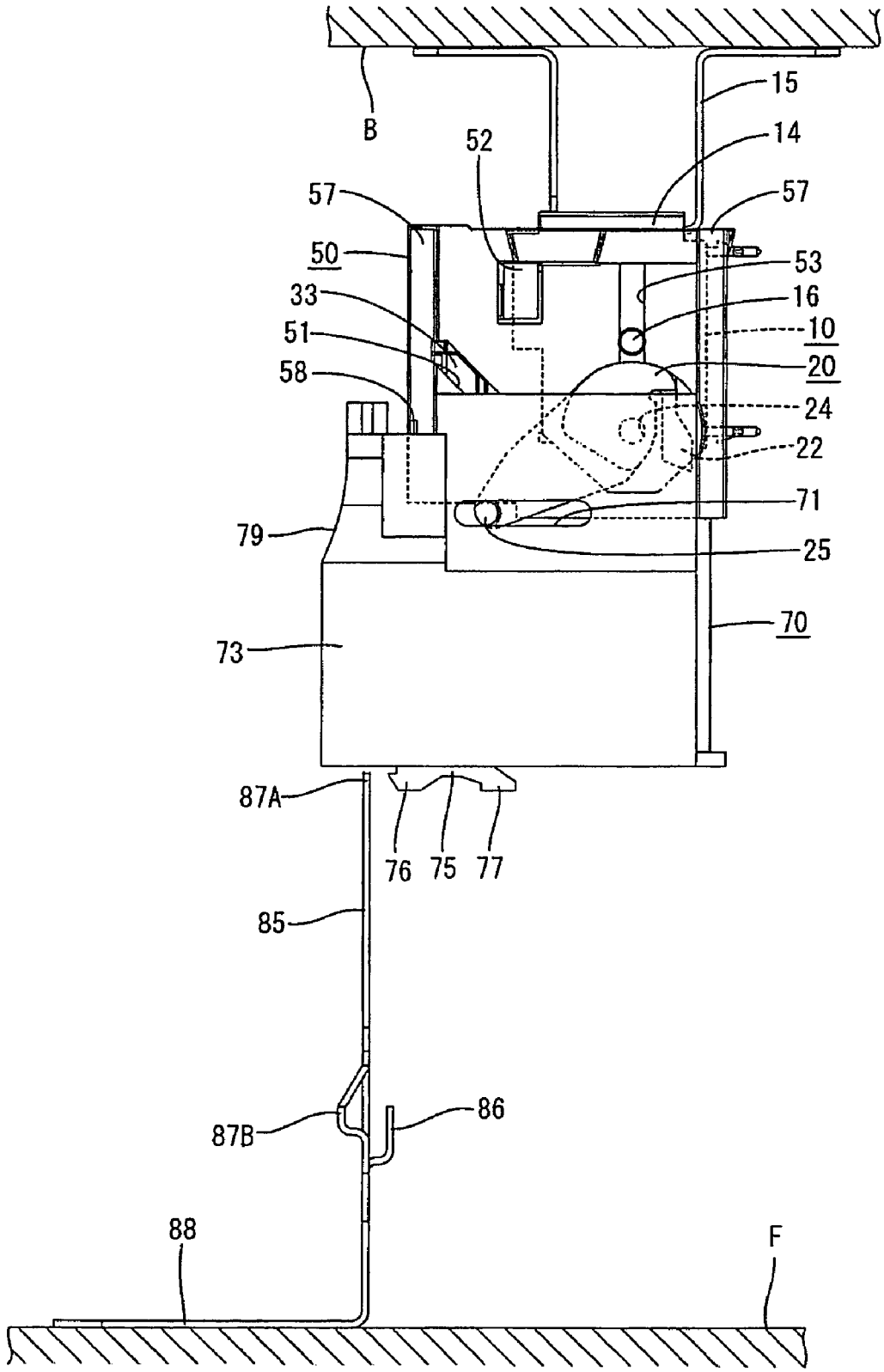
FIG. 2 is a side view showing a state where the male housing is inserted in a casing.
Figure 3:
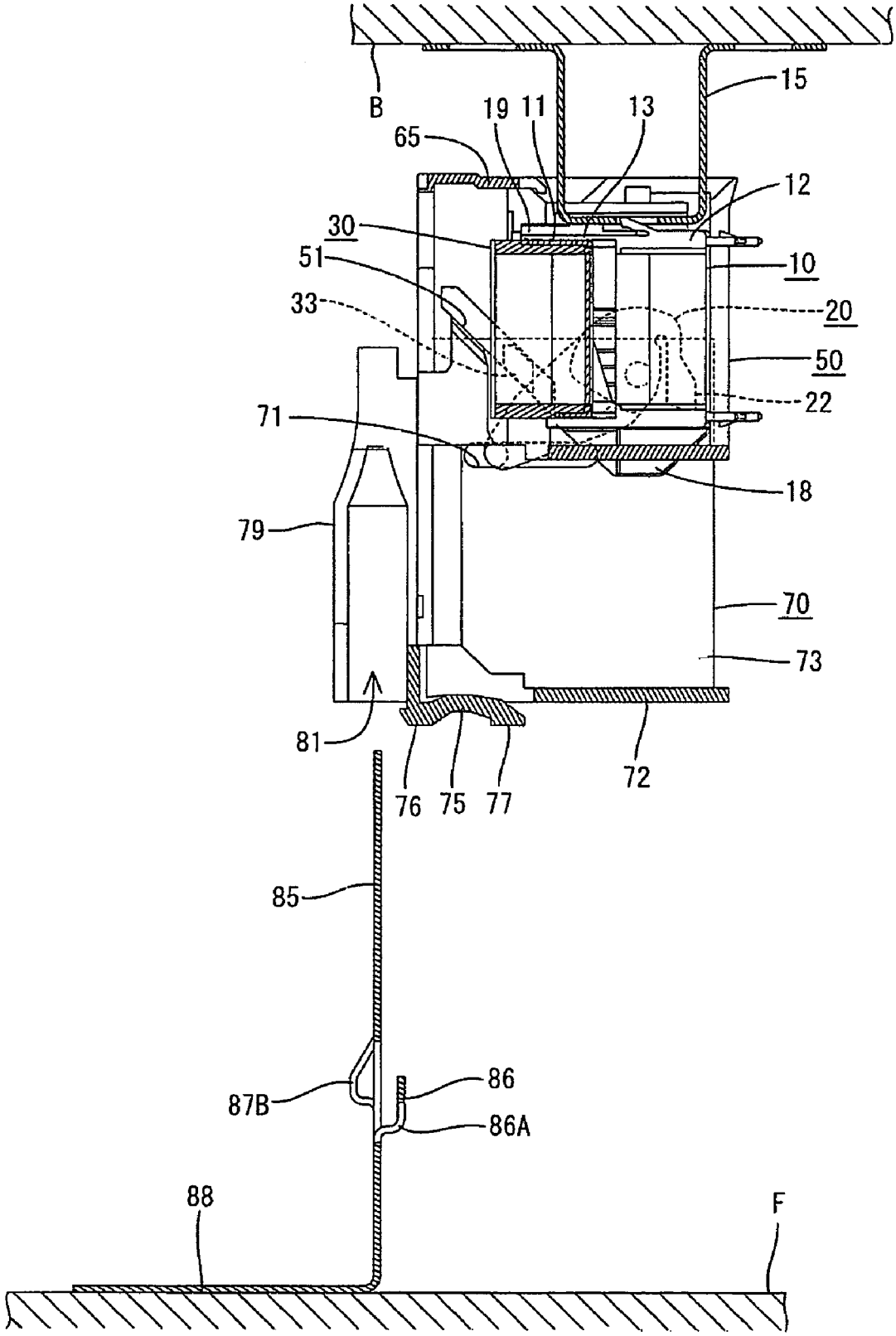
FIG. 3 is a section showing an essential portion of FIG. 2.

The slide 70 is unlocked from the state of FIG. 1 by pushing the unlocking portion 77 and then pushing the operable surface of the operating portion 72 to move the slide 70 and the casing 50 towards the male housing 10. Thus, the male housing 10 is guided through the upper opening 55 and into the casing 50, as shown in FIG. 2. Then, as shown in FIG. 3, the cams 16 of the male housing 10 slide along the cam insertion grooves 53 of the casing 50 and the guiding projections 17 of the male housing 10 slide along the guiding grooves 54 of the casing 50. Further, the pressing portion 19 of the male housing 10 presses the female housing 30 from above to cancel the locked state of the temporary holding portions 34 so that the female housing 30 moves along the guiding cam grooves 51. By this time, the projecting pieces 87A of the holder 85 already have exited the insertion spaces 81 of the mounting boxes 79 and the male housing 10 has been inserted completely into the casing 50 so that a subsequent operation will not be hindered.

The guiding projections 17 contact and deform the resilient locking pieces 22 of the levers 20 in unlocking directions when the male housing 10 is inserted deeply into the casing 50. At this time, the cams 16 are at the entrances of the cam receiving portions 21 of the lever 20. Both male and female terminal fittings start being connected with each other by partly overlapping the leading ends thereof.

Figure 4:
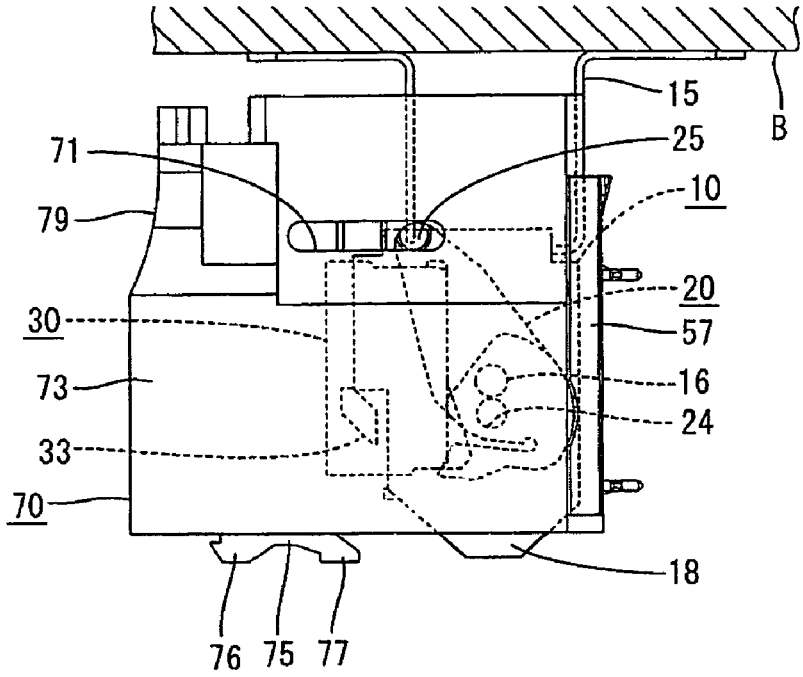
FIG. 4 is a side view showing a state where the male and female housings are properly connected by pushing a slide to an advance position.
Figure 4:
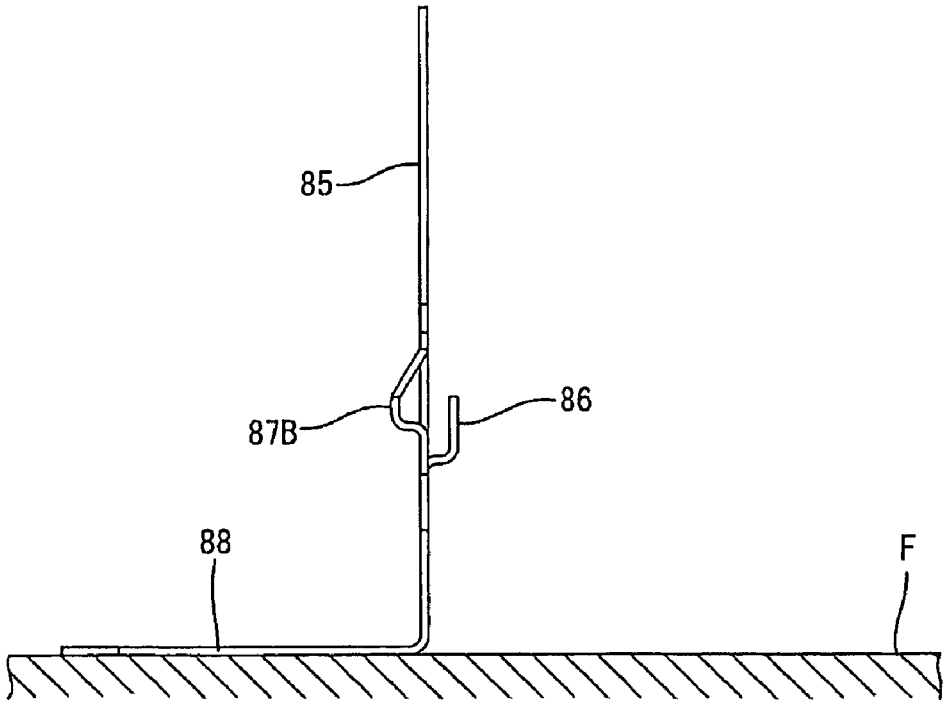

The slide 70 then is pushed so that the operating cams 25 of the levers 20 displace along the operating-cam receiving portions 71 of the slide 70 and the levers 20 rotate (clockwise in the example) about the supporting pins 62. The slide 70 then moves from the retreat position to the advance position and the cams 16 of the male housing 10 displace along the cam receiving portions 21 of the levers 20 so that the connecting operation of the housings 10, 30 proceeds. Rotation of the levers 20 is completed and the two housings 10, 30 are connected properly when the operating portion 72 of the slide 70 reaches a position to be stopped by contact with the bottom wall of the casing 50, as shown in FIGS. 4 and 6. When the slide 70 reaches the advance position in this way, the case lock 83 of the slide 70 engages the engaging portions 58 of the casing 50 so that the slide 70 is locked to the casing 50.

As described above, the slide 70 is kept at the retreat position and the female housing 30 is kept at the initial position by inserting the protector 90 into the fitting space 91 defined between the casing 50 and the operating portion 72 of the slide 70 in the movable-side module M1. Thus, neither the slide 70 nor the female housing will move inadvertently relative to the casing 50 before the connection of the two housings 10, 30 is started. As a result, the slide 70 is at the retreat position and the female housing 30 is at the initial position, and a separate testing apparatus is not needed to confirm these positions and a cost increase is avoided. Connection of the housings 10, 30 can be started quickly at the operation site after the protector 90 is detached.

The protector 90 is fit between the operating portion 72 of the slide 70 and the female housing 30 and extends therebetween. Thus, the construction is simplified without needing to additionally provide the slide 70 or the female housing 30 with an engaging construction with the protector 90.

Further, the entrances of the insertion spaces 81 of the mounting boxes 79 of the slide 70 are closed by the insertion hindering portions 93 of the protector 90. Thus, the operator must detach the protector 90 before mounting the slide 70 onto the holder 85 and is caused to comply with the operation procedure shown in FIG. 10. As a result, a situation where the slide 70 is improperly mounted onto the holder 85 is avoided.

The exposed surface of the lock 75 of the slide 70 is covered by the protecting portion 94 of the protector 90 during transportation. Thus, the lock 75 will not be damaged by an external force. Further, since the locking claw 76 of the lock 75 hooks the surface of the escaping hole 95 of the protecting portion 94, inadvertent resilient deformations of the lock 75 is prevented.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The levers may be supported rotatably in the slide and the casing may be provided with the operating-cam receiving portions. Additionally, any other operable member that displays a cam action (such as a slider or the like) may be used with the invention.

The operating cams may be in the form of grooves and the operating-cam receiving portions may be in the form of pins.

The male housing may be arranged in the movable-side module and the female housing may be arranged in the waiting-side module.

The protector can be constructed so to be held at the retreat position and the female housing can be held at the initial position by inserting the protector into the clearance between the operating portion of the slide and the casing. It is optional to provide the insertion hindering portions and the protecting portion.

What is claimed is:

1. A connector device, comprising:

a casing (50) having at least one guiding cam groove (51);

a first housing (10) in the casing (50);

a second housing (30) mountable into the casing (50) and having a guiding cam groove (33) engageable with and guidable by the guiding cam (51), the second housing (30) being displaceable between an initial position and an end position for connection with the first housing (10);

a moving member (70) having an operating portion (72) and at least one moving mounting portion (73), the moving member (70) being mounted for movement between a retreat position where a clearance is defined between the operating portion (72) and the casing (50) and an advance position that narrows or eliminates the clearance with the moving mounting portion (73) engaged with the casing (50);

at least one operable member (20) operably mounted on one of the moving member (70) and the casing (50), the operable member (20) having at least one cam receiving recess (21) engaged with and supported on the other of the moving member (70) and the casing (50), the cam receiving recess (21) being engageable with at least one cam (16) on the first housing (20), the operable member (20) being operated by moving the moving member (70) from the retreat position to the advance position, whereby the first housing (10) is inserted more deeply into the casing (50) by a cam action of the cam (16) and the cam receiving recess (21), and the second housing (30) engaged with the first housing (10) is displaced relatively from the initial position to the end position by a guiding action of the guiding cam (33) and the guiding cam groove (51) to connect the housings (10, 30); and a protector (90) insertable into a clearance between the operating portion (72) and the casing (50) before the first housing (10) is inserted into the casing (50), the protector (90) contacting the operating portion (72) and the second housing (30) to hold the moving member (70) at the retreat position and to hold the second housing (30) at the initial position.

2. The connector device of claim 1, wherein the moving member (70) has at least one substantially plate-shaped moving mounting portion (73) projecting from the operating portion (72).

3. The connector device of claim 1, wherein the operable member (20) comprises a lever (20) rotatably mounted on one of the moving member (70) and the casing (50), the at least one cam receiving recess (21) engaged with and supported on the other of the moving member (70) and the casing (50) at a position distanced from a center of rotation of the lever (20).

4. The connector device of claim 1, wherein the protector (90) inserted into the clearance extends between the operating portion (72) and the second housing (30).

5. The connector device of claim 1, wherein the moving member (70) is formed with an insertion space (81) for receiving a holding member (85) fixable to a mounting surface (F).

6. The connector device of claim 5, wherein the holding member (85) holds the moving member (70) at the retreat position, and the protector (90) includes an insertion hindering portion (93) for closing the opening of the insertion space (81) when the protector (90) is inserted into the clearance.

7. The connector device of claim 1, wherein at least one lock (75) is formed in an exposed manner at the operating portion (72) of the moving member (70) and is engageable with a holding member (85) fixed to a mounting surface (F) at the retreat position and the protector (90) includes a protecting portion (94) for at least partly covering an exposed surface of the lock (75) when the protector (90) is inserted into the clearance.

* * * * *